US011051611B2

(12) United States Patent
Goldberg et al.

(10) Patent No.: US 11,051,611 B2
(45) Date of Patent: Jul. 6, 2021

(54) DESK SYSTEM

(71) Applicant: Playground Store Limited, Tsim Sha Tsui East (HK)

(72) Inventors: Daniel Goldberg, New York, NY (US); Robert Levine, Shouson Hill (HK); Jedediah J. McCann, Portland, OR (US); Gregory T. Janky, Sammamish, WA (US); Treasure Hinds, Issaquah, WA (US)

(73) Assignee: Playground Store Limited, Tsim Sha Tsui East (HK)

( * ) Notice: Subject to any disclaimer, the term of this patent is extended or adjusted under 35 U.S.C. 154(b) by 0 days.

(21) Appl. No.: 16/753,374

(22) PCT Filed: Apr. 16, 2018

(86) PCT No.: PCT/IB2018/000477
§ 371 (c)(1),
(2) Date: Apr. 3, 2020

(87) PCT Pub. No.: WO2019/202348
PCT Pub. Date: Oct. 24, 2019

(65) Prior Publication Data

US 2020/0275772 A1 Sep. 3, 2020

(51) Int. Cl.
*A47B 21/06* (2006.01)
*A47B 13/08* (2006.01)
(Continued)

(52) U.S. Cl.
CPC ..... *A47B 21/06* (2013.01); *A47B 13/08* (2013.01); *A47B 96/063* (2013.01);
(Continued)

(58) Field of Classification Search
CPC ..... A47B 3/08; A47B 3/0812; A47B 3/0815; A47B 3/0818; A47B 21/06; A47B 13/08;
(Continued)

(56) References Cited

U.S. PATENT DOCUMENTS 240,301 A 4/1881 Buss
617,669 A 1/1899 Blakemore
(Continued)

FOREIGN PATENT DOCUMENTS

CH 588230 A5 5/1977
CH 632654 A5 10/1982
(Continued)

OTHER PUBLICATIONS

International Search Report for PCT/IB2018/000477 by the China National Intellectual Property Administration, dated Jan. 29, 2019, 4 pages.
(Continued)

*Primary Examiner* — Matthew W Ing
(74) *Attorney, Agent, or Firm* — Michael Crilly, Esquire

(57) ABSTRACT

A desk system including desktop, legs, and foot elements is presented. Each leg is rotatably attached at one end to the desktop and attached at another end to one foot element which is also rotatable. The system is disposed in a stowed configuration when legs and foot elements are substantially parallel to the desktop and legs are disposed between and substantially parallel to foot elements. The system is disposed in an upright configuration when legs are substantially perpendicular to the desktop and each leg is substantially perpendicular to one foot element. The system is configured from stowed to upright by separately rotating legs about a minor axis in opposite directions away from one another and by separately rotating foot elements about a major axis in opposite directions toward one another. The system is con-
(Continued)

figured from upright to stowed by separately rotating foot elements about the major axis in opposite directions away from one another and by separately rotating legs about the minor axis in opposite directions toward one another.

20 Claims, 12 Drawing Sheets

(51) Int. Cl.
*A47B 96/06* (2006.01)
*A47B 3/08* (2006.01)

(52) U.S. Cl.
CPC . *A47B 2003/0821* (2013.01); *A47B 2021/066* (2013.01); *A47B 2200/0043* (2013.01); *A47B 2200/0082* (2013.01)

(58) Field of Classification Search
CPC ..... A47B 96/063; A47B 2003/0821; A47B 2021/066; A47B 2200/0043; A47B 2200/0082
See application file for complete search history.

(56) References Cited

U.S. PATENT DOCUMENTS 1,203,783 A 11/1916 Reischmann
1,216,414 A 2/1917 Calkins
1,788,666 A 1/1931 Enders
1,959,725 A 5/1934 Lindsay
2,567,593 A * 9/1951 Bemis ..... A47B 3/0818 108/4
2,683,277 A 7/1954 Bemaerts
2,684,275 A 7/1954 Guth et al.
2,684,883 A 7/1954 Wigell
2,805,906 A 9/1957 Hoven et al.
2,911,274 A 11/1959 Grube
3,676,279 A 7/1972 Beaver
3,845,728 A 11/1974 Pirelli
4,079,679 A 3/1978 Bechtold
4,238,100 A 12/1980 Shy
4,323,291 A 4/1982 Ball
4,440,096 A 4/1984 Rice et al.
4,444,124 A 4/1984 Burr
4,561,622 A 12/1985 Heinzel
4,573,415 A 3/1986 Ramey
4,654,756 A 3/1987 Wilson et al.
4,714,025 A 12/1987 Wallin et al.
4,792,881 A 12/1988 Wilson et al.
D299,798 S 2/1989 Sottsas et al.
4,883,314 A 11/1989 Sakong
4,890,869 A 1/1990 Langkamp, Jr.
4,927,105 A 5/1990 Habermann
5,088,421 A 2/1992 Beckstead
5,101,736 A 4/1992 Bommarito et al.
D334,678 S 4/1993 Hinden
D335,406 S 5/1993 Vonhausen
5,226,250 A 7/1993 Ulmer et al.
5,231,562 A 7/1993 Pierce et al.
5,259,326 A 11/1993 Borgman et al.
5,323,695 A 6/1994 Borgman et al.
5,323,713 A 6/1994 Luyk et al.
5,404,962 A 4/1995 Carter
5,495,811 A 3/1996 Carson et al.
5,562,051 A 10/1996 Rizzi
5,636,578 A 6/1997 Rizzi
5,669,314 A 9/1997 Grant
5,673,633 A 10/1997 Pfister
5,709,156 A 1/1998 Gevaert et al.
5,711,098 A 1/1998 Warne
D399,077 S 10/1998 Lepper et al.
5,845,589 A 12/1998 Pfister
D410,806 S 6/1999 Olson
6,086,028 A 7/2000 Pfister
6,202,567 B1 3/2001 Funk et al.
6,202,571 B1 3/2001 Pallares
6,595,144 B1 7/2003 Doyle
6,637,352 B1 10/2003 Thode et al.
6,694,891 B1 * 2/2004 Lai ..... A47B 3/0818 108/116
6,920,832 B2 7/2005 Lou-Hao
6,962,115 B2 11/2005 Markling et al.
7,350,469 B2 4/2008 Koning et al.
7,631,604 B2 12/2009 Huang
D619,822 S 7/2010 Damgaard-Sorensen
7,908,981 B2 3/2011 Agee
7,942,100 B2 5/2011 Grove et al.
8,051,782 B2 11/2011 Nethken et al.
8,069,795 B1 12/2011 Williams et al.
8,087,738 B2 1/2012 Henriott et al.
8,132,517 B2 3/2012 Leng
8,240,257 B2 8/2012 Frost
3,256,359 A1 9/2012 Agee
8,256,359 B1 9/2012 Agree
D675,041 S 1/2013 Mecherle
8,413,594 B2 4/2013 Ensley
3,490,555 A1 7/2013 Agee
8,893,628 B2 11/2014 McKenzie et al.
8,925,469 B2 1/2015 Bennie et al.
9,038,549 B1 5/2015 Zebarjad
9,084,475 B2 7/2015 Hjelm
9,486,070 B2 11/2016 Labrosse et al.
9,504,318 B1 11/2016 O'Keefe et al.
D776,961 S 1/2017 Yamamoto
9,585,467 B2 3/2017 Leng
9,609,945 B2 4/2017 Krusin et al.
9,635,932 B2 5/2017 Kelley et al.
9,681,747 B1 * 6/2017 Pectol ..... H01R 25/006
9,723,920 B1 8/2017 Wu
9,814,307 B1 11/2017 Hall
9,907,396 B1 3/2018 Labrosse et al.
9,971,340 B1 5/2018 Labrosse et al.
D819,371 S 6/2018 Cao
9,993,068 B2 6/2018 Lin
D846,917 S 4/2019 Hu
D862,129 S 10/2019 Hu
10,455,932 B2 10/2019 Lin
2003/0167980 A1 9/2003 Suzuki
2005/0183641 A1 8/2005 Suzuki
2005/0235886 A1 10/2005 Koning et al.
2005/0263045 A1 12/2005 Lietuvietis
2006/0021553 A1 2/2006 Pleiman et al.
2007/0095257 A1 * 5/2007 Hernandez ..... A47B 3/0815 108/115
2007/0157856 A1 7/2007 Skoog et al.
2007/0234934 A1 10/2007 Branch et al.
2007/0289506 A1 12/2007 Branch et al.
2008/0245279 A1 10/2008 Pan
2009/0151608 A1 6/2009 Aldred
2010/0175598 A1 7/2010 Ballendat
2010/0202852 A1 8/2010 Krause et al.
2010/0231102 A1 9/2010 Block et al.
2011/0147547 A1 6/2011 Fitzpatrick et al.
2012/0248910 A1 10/2012 Randlov
2013/0293173 A1 11/2013 Strothmann
2014/0165884 A1 6/2014 O'Gara
2015/0096477 A1 4/2015 Liu et al.
2016/0037904 A1 2/2016 Wu
2016/0170402 A1 6/2016 Lindstrom
2016/0270521 A1 * 9/2016 Jiang ..... A47B 3/08
2016/0309889 A1 10/2016 Lin et al.
2017/0042322 A1 2/2017 Labrosse
2017/0055720 A1 3/2017 Lin et al.
2017/0251806 A1 9/2017 Newman
2017/0354244 A1 12/2017 Lee et al.
2017/0354248 A1 12/2017 Cohen et al.
2018/0110324 A1 4/2018 Keller et al.
2019/0082823 A1 3/2019 Applegate

(56) References Cited

U.S. PATENT DOCUMENTS

| | | | | |
|---|---|---|---|---|
| 2019/0166987 | A1* | 6/2019 | Diaz | A47B 23/043 |
| 2021/0068531 | A1* | 3/2021 | Tao | A47B 3/083 |

FOREIGN PATENT DOCUMENTS

| | | | |
|---|---|---|---|
| CN | 1795784 | A | 7/2006 |
| CN | 200947912 | Y | 9/2007 |
| CN | 101677680 | A | 3/2010 |
| CN | 201691386 | U | 1/2011 |
| CN | 202140387 | U | 2/2012 |
| CN | 203776371 | | 8/2014 |
| CN | 105476268 | A | 4/2016 |
| DE | 1654640 | B1 | 2/1971 |
| DE | 9104753 | U1 | 7/1991 |
| DE | 202014101396 | U1 | 5/2014 |
| DE | 202016002581 | U1 | 5/2016 |
| DE | 102015008908 | A1 | 1/2017 |
| EP | 0176955 | A2 | 4/1986 |
| EP | 1498047 | A1 | 1/2005 |
| EP | 1829461 | A2 | 9/2007 |
| EP | 1836925 | A1 | 9/2007 |
| EP | 2027793 | A1 | 2/2009 |
| EP | 2786676 | A1 | 10/2014 |
| EP | 2796071 | A1 | 10/2014 |
| EP | 2881007 | A1 | 10/2015 |
| EP | 3001929 | A1 | 4/2016 |
| GB | 191517508 | | 9/1920 |
| GB | 783688 | | 9/1957 |
| GB | 930899 | A | 7/1963 |
| GB | 2352766 | B | 8/2001 |
| GB | 2446570 | A | 8/2008 |
| NL | 1028900 | | 10/2006 |
| WO | 02058510 | A1 | 8/2002 |
| WO | 2005085661 | A1 | 9/2005 |
| WO | 2014/153613 | A1 | 10/2014 |
| WO | 2016059534 | A1 | 4/2016 |

OTHER PUBLICATIONS

Written Opinion of the International Search Authority for PCT/IB2018/000477 by the China National Intellectual Property Administration, dated Jan. 29, 2019, 4 pages.

International Search Report for PCT/IB2019/000380 by the China National Intellectual Property Administration, dated Jul. 30, 2019, 4 pages.

Written Opinion of the International Search Authority for PCT/IB2019/000380 by the China National Intellectual Property Administration, dated Aug. 23, 2019, 4 pages.

* cited by examiner

DESK SYSTEM

CROSS REFERENCE TO RELATED APPLICATIONS

This application is a National Phase of PCT Application No. PCT/IB2018/000477 (formerly PCT Application No. PCT/US2018/027701) filed Apr. 16, 2018 entitled Desk System which is incorporated in its entirety herein by reference thereto.

FEDERALLY SPONSORED RESEARCH AND DEVELOPMENT

None.

BACKGROUND OF THE INVENTION

1. Field of the Invention

The invention generally relates to a desk and more particularly is concerned, for example, with improvements to a desk system facilitating a configure/plug/play solution implemented by tools-free, setup and takedown architecture.

2. Background

A variety of desk systems are provided for in the related arts. Known systems often require one or more tools to facilitate assembly and disassembly, fail to seamlessly integrate with electronic devices, are heavy, and/or are visually distractive and hazardous by failing to conceal wires and elements necessary for connectivity to peripheral components, such as a computer or a network.

Accordingly, what is required are improvements to a desk system which avoid the deficiencies of known systems whereby the improvements simplify setup and takedown, seamlessly integrate with electronic devices, reduce weight without compromising durability and functionality, and provide a visually-appealing, safe solution by concealing wires and components for connectivity to a computer or a network.

SUMMARY OF THE INVENTION

An object of the invention is to provide improvements to a desk system which avoid the deficiencies of known systems whereby the improvements simplify setup and takedown, seamlessly integrate with electronic devices, reduce weight without compromising durability and functionality, and provide a visually-appealing, safe solution by concealing wires and components for connectivity to a computer or a network.

In accordance with an embodiment of the invention, the desk system includes a desktop, a pair of legs, and a pair of foot elements. The desktop has an upper surface and a lower surface bounded by a proximal edge, a distal edge, and a pair of side edges. The desktop further includes a major axis perpendicular to a minor axis. Each leg has a proximal face and a distal face. Each leg is rotatably attached at one end to the desktop and attached at another end to one foot element. The foot element is rotatable with respect to the leg. A first of the legs is disposed between the proximal edge and the proximal face along a second of the legs. The second of the legs is disposed between the distal edge and the distal face along the first of the legs. The proximal face and the distal face have an offset therebetween along the minor axis. The desk system is disposed in a stowed configuration when the legs and the foot elements are substantially parallel to the lower surface and the legs disposed between and substantially parallel to the foot elements. The desk system is disposed in an upright configuration when the legs are substantially perpendicular to the lower surface and each leg substantially perpendicular to one foot element. The desk system is configured from the stowed configuration to the upright configuration by separately rotating the legs about the minor axis in opposite directions away from one another and by separately rotating the foot elements about the major axis in opposite directions toward one another. The desk system is configured from the upright configuration to the stowed configuration by separately rotating the foot elements about the major axis in opposite directions away from one another and by separately rotating the legs about the minor axis in opposite directions toward one another.

In accordance with other embodiments of the invention, one leg is hingedly attached and releasably securable along the lower surface adjacent to one side edge, and another leg is hingedly attached and releasably securable along the lower surface adjacent to another side edge.

In accordance with other embodiments of the invention, one foot element is hingedly attached and releasably securable to one leg, and another foot element is hingedly attached and releasably securable to another leg.

In accordance with other embodiments of the invention, each foot element includes a first portion, a second portion, and a third portion whereby the first portion is bounded by a first end and a latch point, the second portion is bounded by the latch point and a hinge point, and the third portion is bounded by the hinge point and a second end.

In accordance with other embodiments of the invention, the first portion is at least as long as the combination of the second portion and the third portion.

In accordance with other embodiments of the invention, the desktop includes an upper layer, an intermediate layer, and a lower layer cooperating to form a pocket with a porous layer therein.

In accordance with other embodiments of the invention, the porous layer is in the form of a honeycomb.

In accordance with other embodiments of the invention, the desk system further includes a bezel disposed within an opening along the desktop adjacent to the distal edge wherein the bezel includes a slot, at least one outlet, or at least one port.

In accordance with other embodiments of the invention, a handle is formed by a portion of the upper layer, the intermediate layer, and the lower layer disposed between the slot and the distal edge.

In accordance with other embodiments of the invention, the desk system further includes a controller disposed within an opening along the desktop and biased toward the proximal edge and one side edge.

In accordance with other embodiments of the invention, the desk system further includes a tray attached to the desktop along the lower surface to form a cavity therebetween wherein the cavity is capable of accepting a cable for support and concealment by the tray.

In accordance with other embodiments of the invention, the legs are of fixed length.

In accordance with other embodiments of the invention, the legs are extendable and retractable.

In accordance with other embodiments of the invention, each leg includes a motor for extending and retracting the leg to adjust the height of the desktop.

In accordance with other embodiments of the invention, the desk system further includes a control module communicable with the motor in each leg and a controller.

In accordance with other embodiments of the invention, the control module facilitates access to a communications network.

In accordance with other embodiments of the invention, cables between the controller and each of the motors and the control module are at least partially concealed within the desktop between an upper layer and an intermediate layer, the upper layer and a porous layer, a lower layer and the porous layer, or the lower layer and the intermediate layer.

In accordance with other embodiments of the invention, a cross member is attached to the desktop along the lower surface.

In accordance with other embodiments of the invention, a latch releasably secures a leg to the desktop when disposed in an upright configuration enabling tool-free reconfiguration of the desk system.

In accordance with other embodiments of the invention, a latch releasably secures a foot element to a leg when disposed in an upright configuration enabling tool-free reconfiguration of the desk system.

Several advantages of the invention include, but are not limited to, the following. The invention provides a compact, portable desk solution for use within commercial, home, institutional, and a variety of other settings. The invention avoids trip hazards and visual distractions inherent to connectivity between peripheral components and a desk system. The invention provides a configure/plug/play solution after removal from a shipping box whereby legs and feet are rotated and locked into place without tools, a computer is physically and electronically coupled to the desktop, and both desk and computer used for productive activities. The invention is adaptable to a variety of uses and users.

The above and other objectives, features, and advantages of the preferred embodiments of the invention will become apparent from the following description read in connection with the accompanying drawings, in which like reference numerals designate the same or similar elements.

BRIEF DESCRIPTION OF THE DRAWINGS

Additional aspects, features, and advantages of the invention will be understood and will become more readily apparent when the invention is considered in the light of the following description made in conjunction with the accompanying drawings.

DETAILED DESCRIPTION OF THE INVENTION

Figure 1:
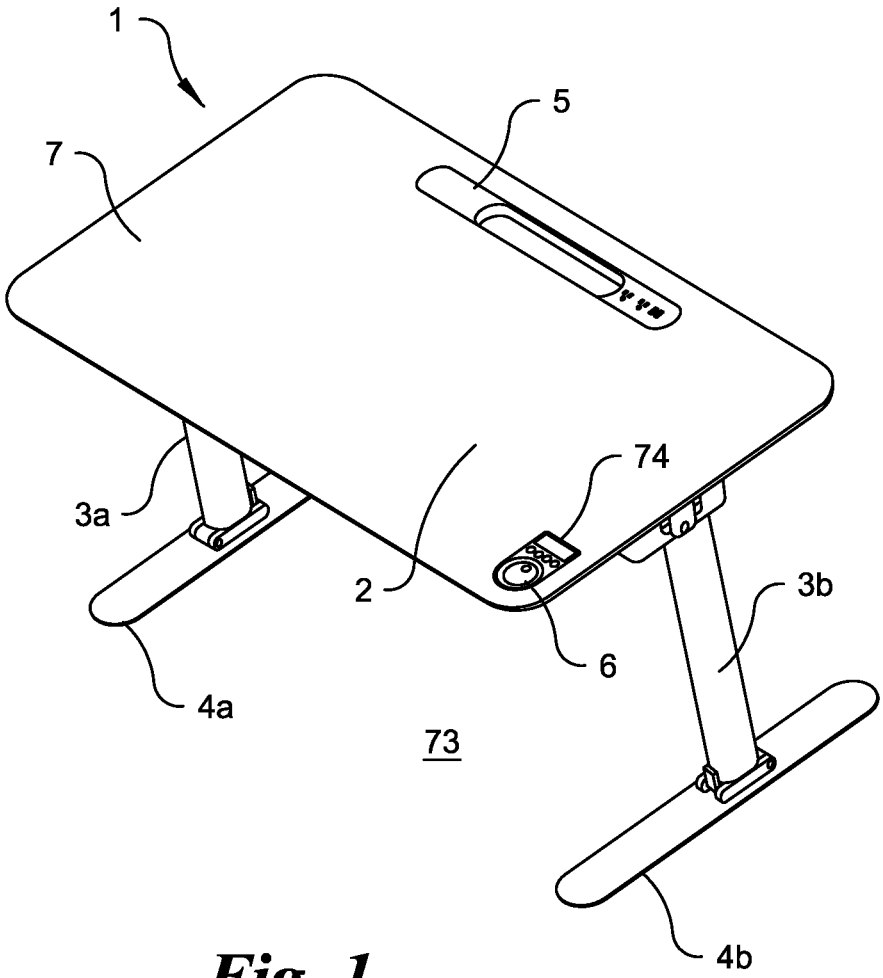
FIG. 1 is a top-side perspective view illustrating desktop, legs, and foot elements arranged to form the upright configuration of the desk system in accordance with an embodiment of the invention.

Reference will now be made in detail to embodiments of the invention that are illustrated in the accompanying drawings. Wherever possible, same or similar reference numerals are used in the drawings and the description to refer to the same or like parts. The drawings are in simplified form and are not to precise scale.

While features of various embodiments are separately described herein, it is understood that such features may be combinable to form other additional embodiments.

Figure 2:
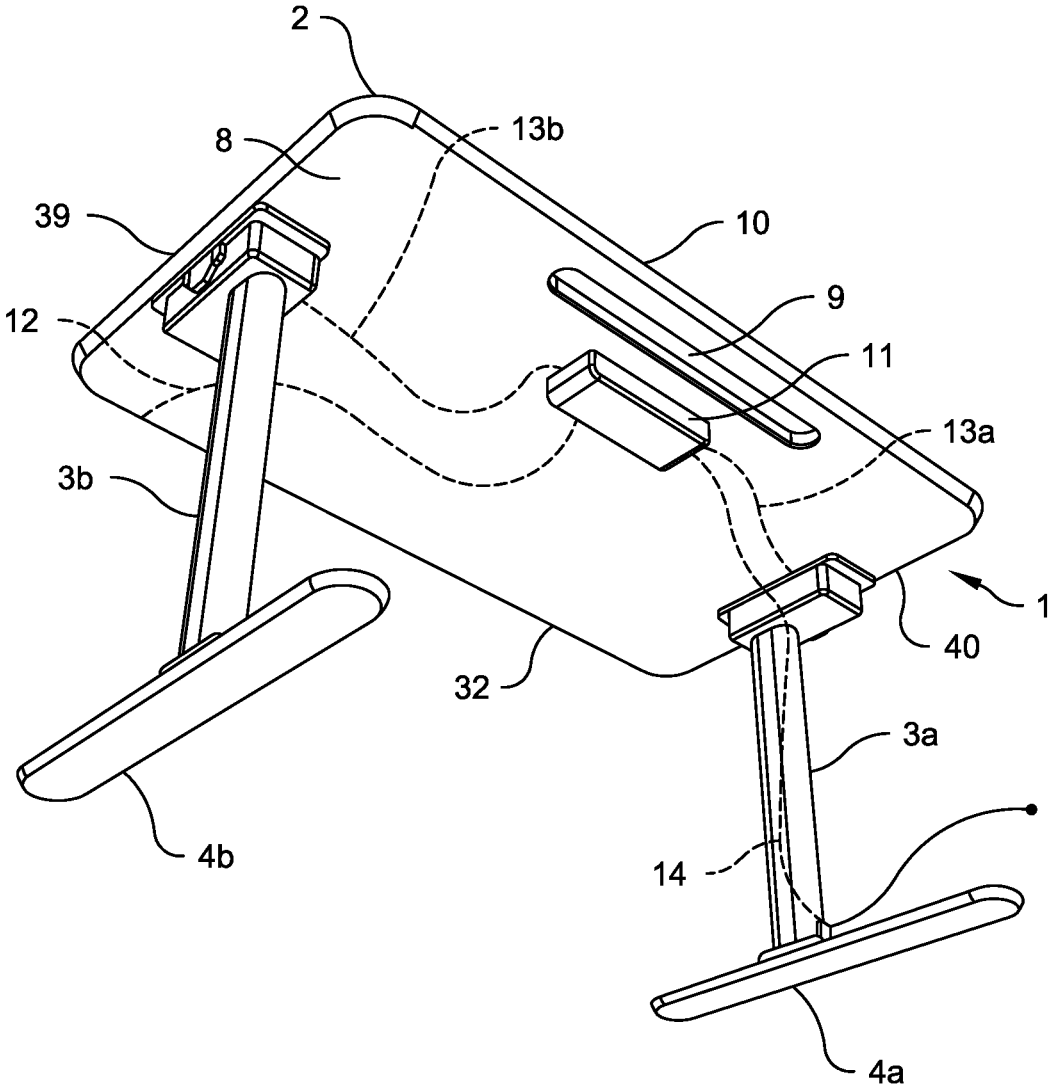
FIG. 2 is a bottom-side perspective view illustrating desktop, legs, and foot elements arranged to form the upright configuration of the desk system in accordance with an embodiment of the invention.

Referring now to FIGS. 1 and 2, the desk system 1 includes a desktop 2, a pair of legs 3*a*, 3*b*, and a pair of foot elements 4*a*, 4*b*. Desktop 2, legs 3*a*, 3*b*, and foot elements 4*a*, 4*b* may be constructed of one or more materials suitable for such components. The desktop 2 may be further constructed of one or more layers. The desktop 2 is a generally planar element including an upper surface 7 and a lower surface 8 bounded by a distal edge 10, a proximal edge 32, and a pair of side edges 39, 40. The upper surface 7 generally defines the work area provided by the desk system 1 and therefore should be sufficiently supportive and resistant to wear commensurate with intended use. When in use, the legs 3*a*, 3*b* are substantially perpendicular to the desktop 2 and the foot elements 4*a*, 4*b* are substantially perpendicular to the respective legs 3*a*, 3*b* and further substantially parallel to the desktop 2. In some embodiments, the legs 3*a*, 3*b* may be fixed lengthwise and therefore not adjustable in length. In other embodiments, the legs 3*a*, 3*b* may telescope or otherwise extend and retract so as to raise and lower the desktop 2 for use in either a stand position or a sit position, respectively. The foot elements 4*a*, 4*b* extend outward from opposite sides of the respective legs 3*a*, 3*b*, preferably oriented toward the distal edge 10 and the proximal edge 32, so as to maintain orientation and stability of the desktop 2 with respect to a supporting surface 73, one example of the latter being a floor. The dimensional properties of the foot elements 4*a*, 4*b* are design specific determined in part by such factors as the minimum and maximum lengths of the legs 3*a*, 3*b*, the length, width, weight and weight distribution of the desktop 2, and the location of each leg 3*a*, 3*b* with respect to the desktop 2.

Referring again to FIGS. 1 and 2, the desk system 1 may include an optional bezel 5. The bezel 5 may be situated along the upper surface 7 of the desktop 2 and biased toward the distal edge 10. In preferred embodiments, the bezel 5 is positioned within an opening 9 so as to be mounted in a flush-wise arrangement with respect to the upper surface 7. In some embodiments, the bezel 5 may be fixed within the opening 9 via mechanical, adhesive or other means understood in the art. In yet other embodiments, the bezel 5 may be removable from the opening 9 for such purposes as cleaning or repair. Referring again to FIGS. 1 and 2, the desk system 1 may include an optional controller 6. The controller 6 may be situated along the upper surface 7 of the desktop 2 and biased toward the proximal edge 32 and one of the two side edges 39, 40, a right-side mount illustrated by way of example in FIG. 1. In preferred embodiments, the controller 6 is mounted within a like-sized recess along the desktop 2 so as to reside in a flush-wise arrangement with respect to the upper surface 7. The controller 6 may be either fixed within or removable from the recess.

Referring again to FIGS. 1 and 2, the desk system 1 may include an optional control module 11. The control module 11 could be fixed via mechanical, adhesive or other means understood in the art to the lower surface 8 so as to be generally concealed from view yet accessible for engaging and disengaging cables and the like. The control module 11 may be communicable with the controller 6 via a cable 12 and the legs 3*a*, 3*b* via cables 13*a*, 13*b*. The control module 11 may also be communicable with components in the bezel 5 via cabling, the latter not shown. The control module 11 may be connected to an external power source, such as a wall outlet, via a power cable 14. In preferred embodiments, the cables 12, 13*a*, 13*b* and one portion of the power cable 14 could be concealed within the desktop 2 and another portion of the power cable 14 could be concealed within one of the legs 3*a*, 3*b*.

Figure 3:
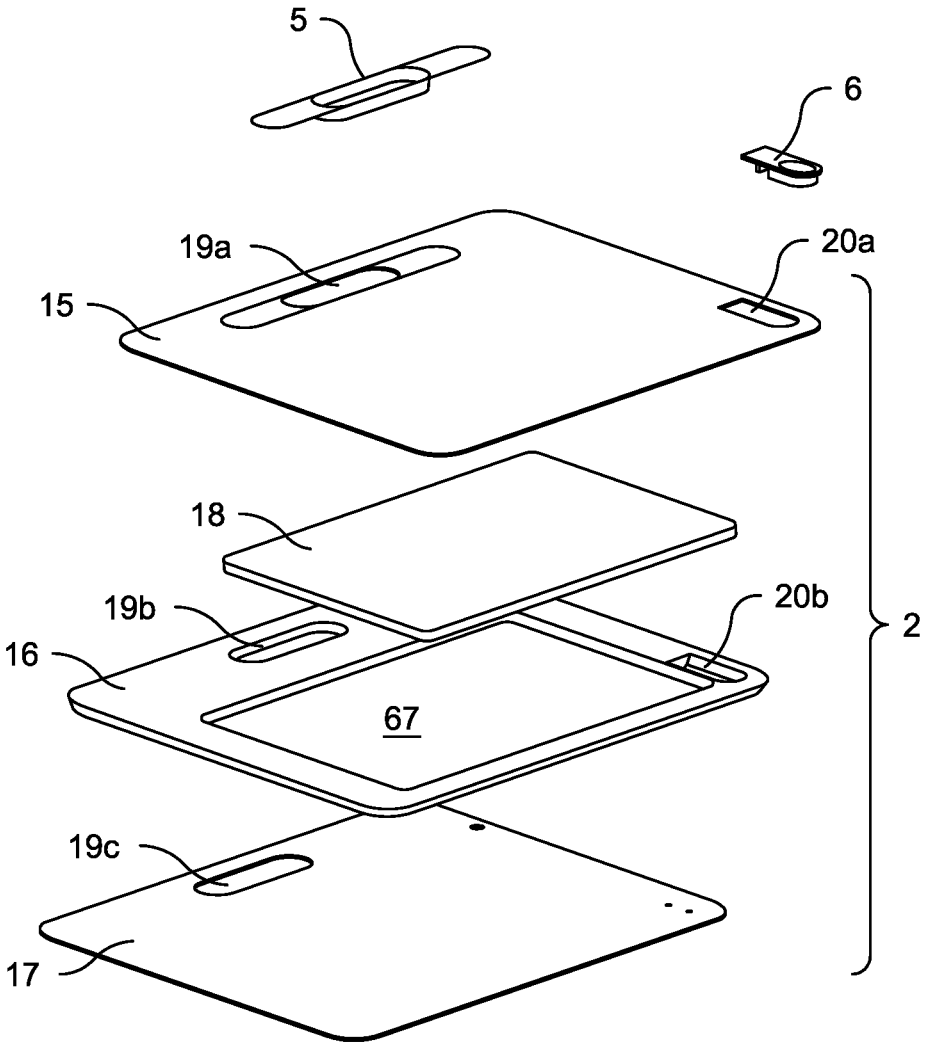
FIG. 3 is an exploded view illustrating upper layer, intermediate layer, porous layer, and lower layer with optional bezel, controller, cross member, and tray in accordance with an embodiment of the invention.

Referring now to FIG. 3, the desktop 2 may be constructed of one or more layers. A multi-layer construction could include two or more materials attached in a plane-wise arrangement via mechanical, adhesive or other means understood in the art. In preferred embodiments, the desktop 2 includes an upper layer 15, an intermediate layer 16, and a lower layer 17. The upper layer 15, the intermediate layer 16, and the lower layer 17 may be composed of wood, plastic, composite, glass, metal and/or other material(s) suitable for use in a desktop 2. The intermediate layer 16 may include an opening which cooperates with the upper layer 15 and the lower layer 17 to define a pocket 67. The pocket 67 may be situated so that the intermediate layer 16 forms the sides of the pocket 67 and the upper layer 15 and lower layer 17 form top and bottom boundaries of the pocket 67, respectively. In preferred embodiments, a porous layer 18 could be situated within the pocket 67 to enhance the stiffness of the desktop 2 or the layers thereof while minimizing the weight of the desk system 1. Non-limiting examples of the porous layer 18 is a honeycomb structure constructed of wood, cardboard, plastic, or other material(s) suitable for the use. In some embodiments, the porous layer 18 could completely fill the pocket 67 and could be fixed to one or more of the upper layer 15, the intermediate layer 16 and the lower layer 17 via mechanical, adhesive or others means understood in the art. In other embodiments, the porous layer 18 could be freely or loosely situated within the pocket 67.

Referring again to FIG. 3, optional openings 19*a*, 19*b*, 19*c* could reside along the upper layer 15, the intermediate layer 16, and the lower layer 17, respectively. The openings 19*a*, 19*b*, 19*c* are situated so as to align when the upper layer 15, the intermediate layer 16, and the lower layer 17 are assembled to form the desktop 2 thereby forming the opening 9 illustrated in FIG. 2. The openings 19*a*, 19*b*, 19*c* are sized and shaped to accept the bezel 5.

Referring again to FIG. 3, optional openings 20*a*, 20*b* could reside along the upper layer 15 and the intermediate layer 16. The openings 20*a*, 20*b* are situated so as to align when the upper layer 15, the intermediate layer 16, and the lower layer 17 are assembled to form the desktop 2, thereby forming a pocket 74 as generally identified in FIG. 1. The openings 20*a*, 20*b* are sized and shaped to accept the controller 6.

Figure 4:
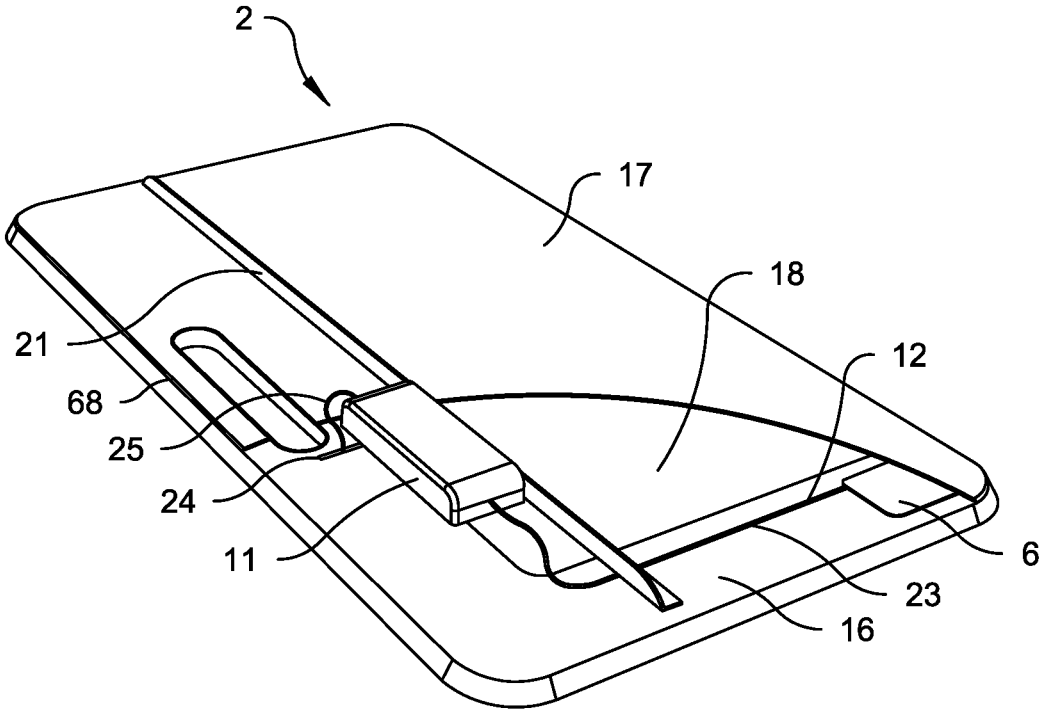
FIG. 4 is a perspective view with partial section illustrating a porous layer embedded within a pocket formed by upper layer, intermediate layer, and lower layer with cables embedded within the desktop in accordance with an embodiment of the invention.

Referring now to FIG. 4, cable 12, 13*a*, 13*b* and other means for communication between components could be concealed within the desktop 2 to minimize trip hazards and to improve overall appearance of the desk system 1. By way of example, a cable 12 could be disposed within a groove 23 or the like permitting enclosure by the lower layer 17. The groove 23 could traverse a pathway along the intermediate layer 16 and the porous layer 18 from the controller 6 to the control module 11. In other embodiments, the groove 23 could be disposed along the upper layer 15 or the lower layer 17. In yet other embodiments, the groove 23 could partially reside within both layers along the interface between the upper layer 15 and the intermediate layer 16, the upper layer 15 and the porous layer 18, the lower layer 17 and the porous layer 18, and/or the intermediate layer 16 and the lower layer 17. It is understood that the location of the pathway formed by the groove 23 is determined by such factors as the connectivity required between components and the locations of components.

Referring again to FIG. 4, one or more other pathways could reside along the desktop 2 permitting routing of cables to other parts of the desktop 2. For example, a slot 24 may be provided which allows a cable 25 attached to the control module 11 to pass into and through one or more of the upper layer 15, the intermediate layer 16, and the lower layer 17 for connection to components along the bezel 5.

Referring again to FIG. 4, optional components such as a cross member 21 could be attached to the lower layer 17 opposite of the intermediate layer 16 via mechanical, adhesive or other means understood in the art. The cross member 21 may be a bracket or other component suitable for stiffening and/or facilitating attachment of optional components of the desk system 1 to the underside of the desktop 2.

Figure 5:
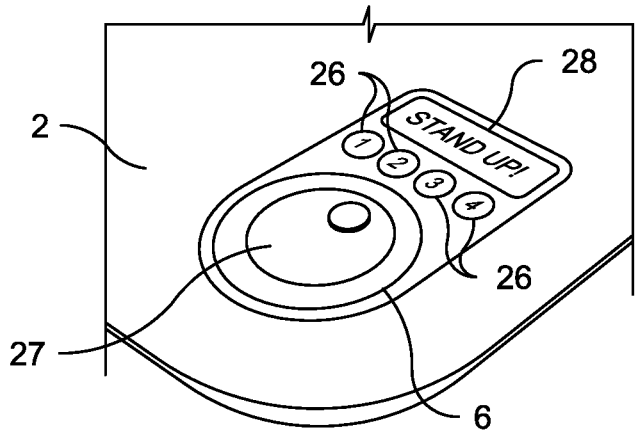
FIG. 5 is an enlarged perspective view illustrating button, dial, and display features of an exemplary controller in accordance with an embodiment of the invention.

Referring now to FIG. 5, the controller 6 may include means permitting communication with one or more components of the desk system 1 facilitated by wire or wireless means. By way of example, the controller 6 could include one or more buttons 26, dials 27, or other the like which enable selection or tuning of parameters, one non-limiting example being height of the desktop 2. Buttons 26 may permit selection of a preprogrammed height whereas the dial 27 may permit for heights not otherwise accessible via the buttons 26. In some embodiments, one or more buttons 26 could be programmable whereby a user depresses a button 26 for a specific time period so that the depressed button 26 corresponds to the programmed height which is thereafter retrievable by depressing the now programmed button 26. A display 28, such as a LED screen, may visually communicate information to the user corresponding to the feature selected via buttons 26 or dial 27.

Figure 6:
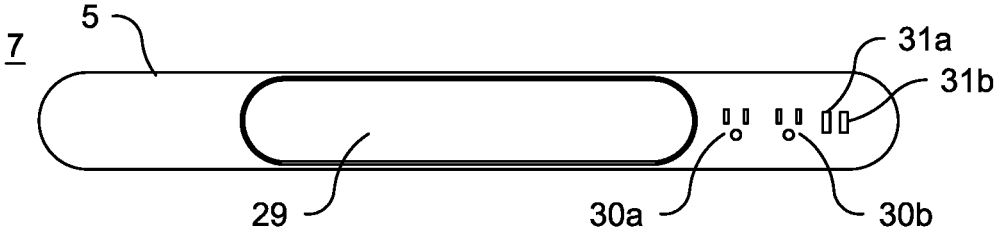
FIG. 6 is an enlarged perspective view illustrating slot, outlet, and port features of an exemplary bezel in accordance with an embodiment of the invention.

Referring now to FIG. 6, the bezel 5 may include means permitting connectivity of devices, such as a computer, a printer, or a network, to one another and/or to the desk system 1. The bezel 5 may be composed of one or more materials suitable to the application. By way of example, the bezel 5 could include one or more outlets 30*a*, 30*b* and/or ports 31*a*, 31*b* accessible adjacent to the upper surface 7. One non-limiting example of the ports 31*a*, 31*b* is a socket capable of accepting a USB connector. In some embodiments, the outlets 30*a*, 30*b* and/or the ports 31*a*, 31*b* could be directly or indirectly connected to the control module 11. In other embodiments, the outlets 30*a*, 30*b* and/or the ports 31*a*, 31*b* could connect to components separate from the desk system 1.

Referring again to FIGS. 4 and 6, the bezel 5 may include a slot 29. The slot 29 could be situated adjacent to the distal edge 10 so that the portion of the desktop 2 therebetween forms a handle 68. In preferred embodiments, the handle 68 is either centered along the length of the desktop 2 or positioned at the center of mass along the length of the desktop 2 so that the desk system 1 is portable in a generally vertical and balanced orientation.

Figure 7:
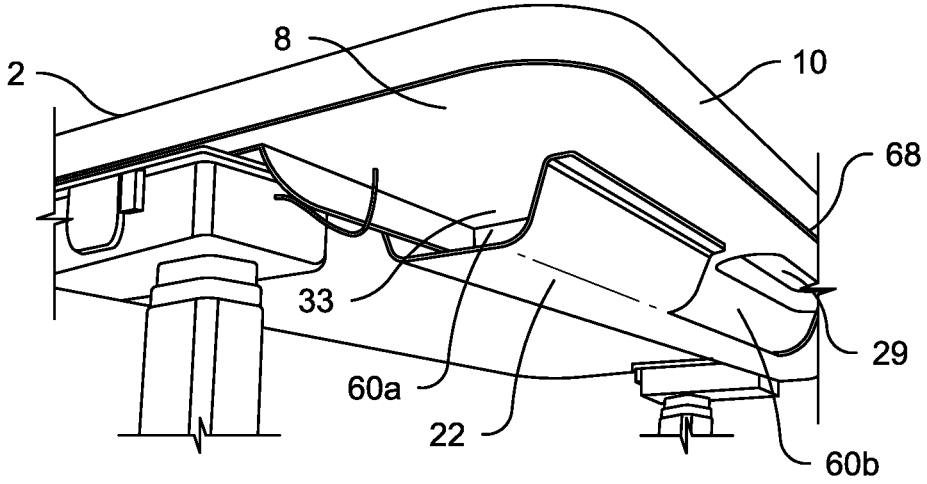
FIG. 7 is an enlarged perspective view illustrating tray disposed along and secured to the lower surface of the desktop in accordance with an embodiment of the invention.

Referring now to FIG. 7, an optional component such as a tray 22 could be attached to the lower surface 8 opposite of the intermediate layer 16 via mechanical, adhesive or other means understood in the art. The tray 22 could be a u-shaped element or the like suitable for routing and at least partially concealing wires between devices used with but otherwise not part of the desk system 1, one non-limiting example being a computer. The tray 22 may be composed of one or more materials suitable to the application.

Referring again to FIG. 7, a cavity 33 is formed by and between the tray 22 and the lower surface 8 of the desktop 2. The cavity 33 could be accessible via one or more openings 60*a*, 60*b*. In one example, an opening 60*a* may be formed at one or each end of the tray 22 thereby allowing cabling to be inserted into or removed from the cavity 33. In another example, an opening 60*b* could be formed along the mid-section of the tray 22 adjacent to the slot 29 whereby the opening 60*b* facilitates proper placement of cabling within and through the cavity 33. The shape, size, and location of the opening 60*b* adjacent to the distal edge 10 may be determined in part to avoid interference with the handle 68.

Figure 8:
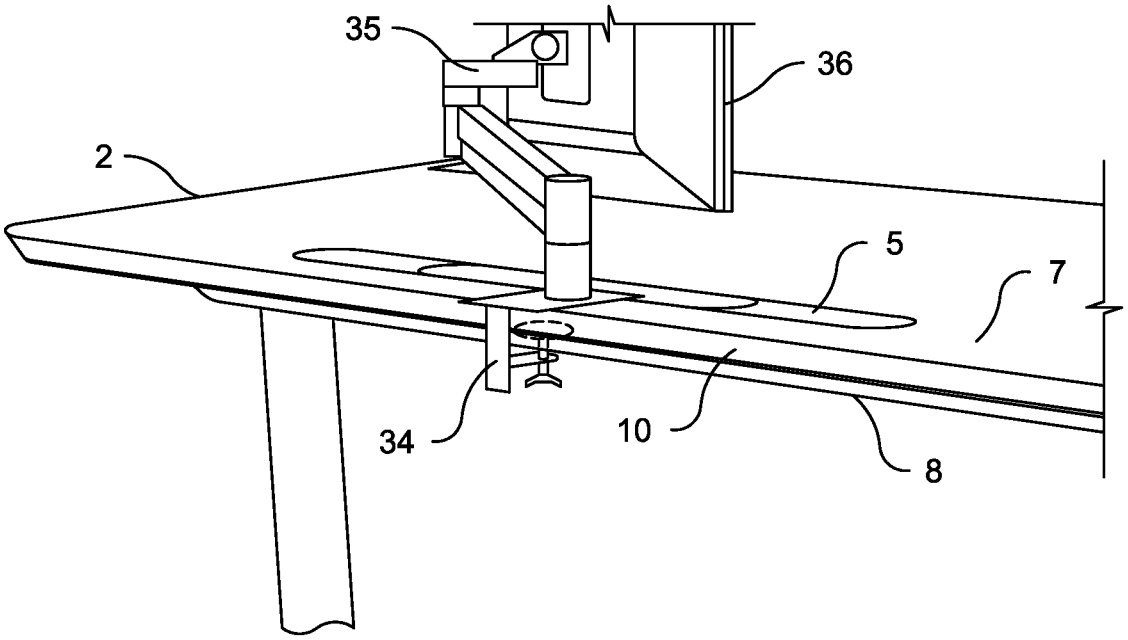
FIG. 8 is an enlarged perspective view illustrating attachment of an electronic device at the distal edge of a desktop adjacent to the bezel in accordance with an embodiment of the invention.

Referring now to FIG. 8, the upper surface 7 and the lower surface 8 are generally disposed to permit attachment of a device 36 to the desktop 2. Exemplary devices 36 include, but are not limited to, flat-panel displays and all-in-one computers. In some embodiments, both upper and lower surfaces 7, 8 could be substantially parallel adjacent to the bezel 5 at the distal edge 10 so as to allow a clamp 34 or the like to be secured to the desktop 2. The clamp 34 could support an arm 35 and a device 36 attached thereto in an upright orientation so that the device 36 is properly positioned for use with the desk system 1.

Figure 9A:
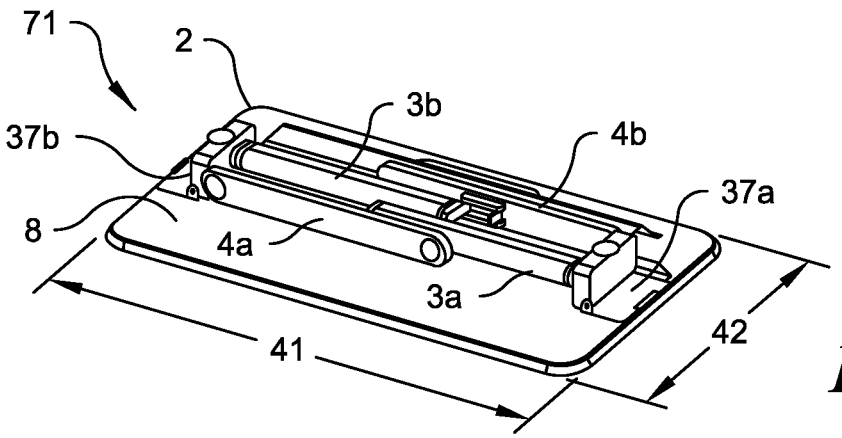
FIG. 9*a* is a bottom-side perspective view illustrating arrangement of legs and foot elements with respect to the desktop to form the stowed configuration in accordance with an embodiment of the invention.
Figure 9B:
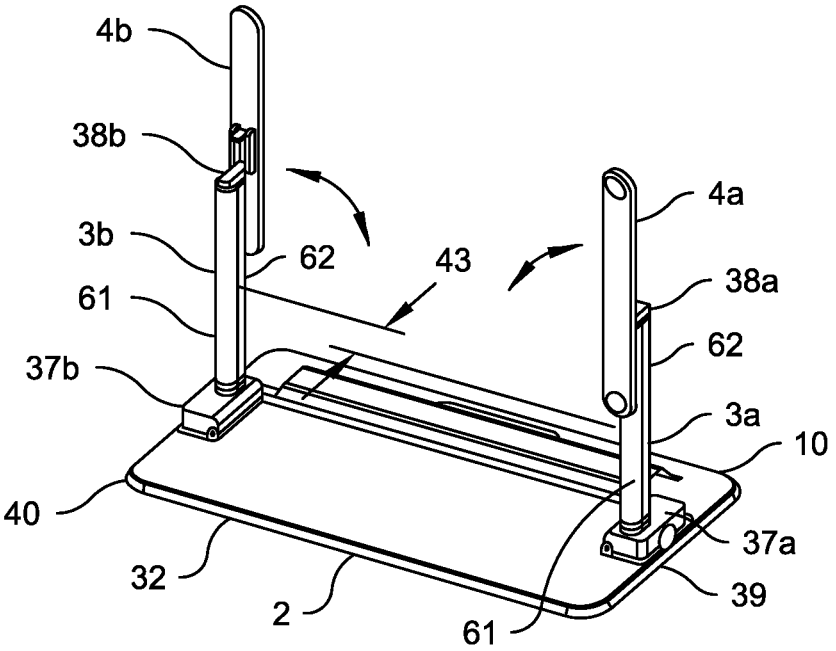
FIG. 9*b* is a bottom-side perspective view illustrating arrangement of legs and foot elements with respect to the desktop between the stowed configuration and the upright configuration and offset feature between the legs in accordance with an embodiment of the invention.
Figure 9C:
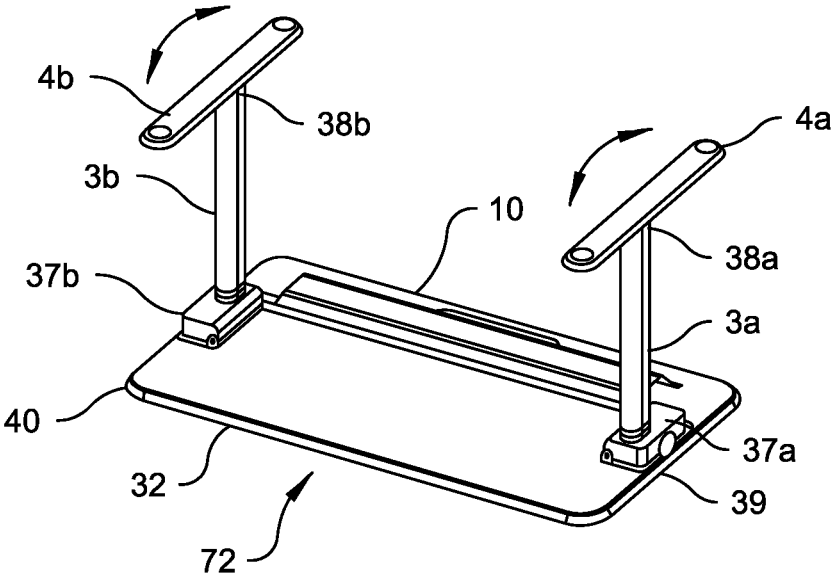
FIG. 9*c* is a bottom-side perspective view illustrating arrangement of legs and foot elements with respect to the desktop to form the upright configuration in accordance with an embodiment of the invention.

Referring now to FIGS. 9*a*-9*c*, the legs 3*a*, 3*b* and the foot elements 4*a*, 4*b* are adjustable with respect to the major axis 41 and the minor axis 42 of the desktop 2 to form either a stowed configuration 71 as illustrated in FIG. 9*a* or an upright configuration 72 as illustrated in FIG. 9*c*. The major axis 41 is orientated along the lengthwise direction of the desktop 2. The minor axis 42 is orientated along the widthwise direction of the desktop 2. It is understood that the major axis 41 is perpendicular to the minor axis 42.

Referring again to FIGS. 9*a*-9*c*, each leg 3*a*, 3*b* is hingedly attached to the desktop 2 via a leg hinge 37*a*, 37*b* and hingedly attached to a foot element 4*a*, 4*b* via a foot hinge 38*a*, 38*b*. One leg 3*a* is attached at one end adjacent to one side edge 39 of the desktop 2 via a leg hinge 37*a* and is further attached at another end to a foot element 4*a* via a foot hinge 38*a*. Another leg 3*b* is attached at one end adjacent to another side edge 40 of the desktop 2 via a leg hinge 37*b* and is further attached at another end to a foot element 4*b* via a foot hinge 38*b*. Each leg hinge 37*a*, 37*b* permits a leg 3*a*, 3*b* to rotate about the minor axis 42 whereas each foot hinge 38*a*, 38*b* permits a foot element 4*a*, 4*b* to rotate about the major axis 41. It is therefore understood that the rotational plane of each leg 3*a*, 3*b* is perpendicular to the rotational plane of the respective foot element 4, 4*b*. The result being a two-dimensional folding and unfolding of the legs 3*a*, 3*b* with respect to the desktop 2 and a three-dimensional folding and unfolding of the foot elements 4*a*, 4*b* with respect to the desktop 2.

Referring again to FIGS. 9*a*-9*c*, the legs 3*a*, 3*b* are positioned along the minor axis 42 with an offset 43. The offset 43 causes one leg 3*a* or 3*b* to be biased toward the proximal edge 32 and another leg 3*a* or 3*b* to be biased toward the distal edge 10. The offset 43 may be equal to or greater than 0. Overlapping legs 3*a*, 3*b* may slidingly contact when the offset 43 is 0. The legs 3*a*, 3*b* may rotate with or without contact between the stowed configuration 71 and the upright configuration 72 when the offset 43 is greater than 0. Regardless of the value for the offset 43, the legs 3*a*, 3*b* may or may not at least partially overlap in the stowed configuration 71, the former illustrated in FIG. 9*a*.

Referring again to FIGS. 9*a*-9*c*, the stowed configuration 71 illustrated in FIG. 9*a* is typically appropriate when the desk system 1 is shipped to an end user, in storage, or moved to a new location. The legs 3*a*, 3*b* are oriented so as to be parallel or nearly parallel, therefore substantially parallel, to one another and to the lower surface 8 along the desktop 2. The foot elements 4*a*, 4*b* are also aligned along the major axis 41 so as to be parallel or nearly parallel to one another, to the legs 3*a*, 3*b*, and to the lower surface 8 along the desktop 2. The resultant orientation situates a first leg 3*a* or 3*b* between the proximal face 61 of a second leg 3*a* or 3*b* and the proximal edge 32 and situates a second leg 3*a* or 3*b* between the distal face 62 of a first leg 3*a* or 3*b* and the distal edge 10. The legs 3*a*, 3*b* and/or the foot elements 4*a*, 4*b* may or may not directly contact the lower surface 8. The offset 43 is generally defined as the distance along the minor axis 42 between the proximal face 61 of one leg 3*a* or 3*b* and the distal face 62 of another leg 3*a* or 3*b*. The offset 43 therefore is the space or separation between the legs 3*a*, 3*b* as defined by the proximal face 61 and the distal face 62 bounded by and between the legs 3*a*, 3*b*.

Referring again to FIGS. 9*a*-9*c*, the legs 3*a*, 3*b* are transformed from the stowed configuration 71 to the upright configuration 72 by first rotating the legs 3*a*, 3*b* in opposite directions about the minor axis 42 away from the lower surface 8 as illustrated in FIG. 9*b*. The resultant motion causes the legs 3*a*, 3*b* to move away or separate from one another. Rotation ceases when each leg 3*a*, 3*b* is perpendicular or nearly perpendicular, therefore substantially perpendicular, to the desktop 2, as also illustrated in FIG. 9*b*. Next, the foot elements 4*a*, 4*b* are rotated in opposite directions about the major axis 41 and toward one another as illustrated in FIG. 9*c*. Rotation ceases when each foot element 4*a*, 4*b* is perpendicular or nearly perpendicular to the respective leg 3*a*, 3*b* and parallel or nearly parallel to the desktop 2 as also illustrated in FIG. 9*c*.

Referring again to FIGS. 9*a*-9*c*, the upright configuration 72 illustrated in FIG. 9*c* is typically appropriate when the desk system 1 is in use. The legs 3*a*, 3*b* are oriented so as to be parallel or nearly parallel to one another, perpendicular or nearly perpendicular to the lower surface 8 along the desktop 2, and perpendicular or nearly perpendicular to the foot elements 4*a*, 4*b*. The foot elements 4*a*, 4*b* are generally aligned along the minor axis 42.

Referring again to FIGS. 9*a*-9*c*, the legs 3*a*, 3*b* are transformed from the upright configuration 72 to the stowed configuration 71 by first rotating the foot elements 4*a*, 4*b* in opposite directions about the major axis 41 as illustrated in FIG. 9*c*. The resultant motion causes the foot elements 4*a*, 4*b* to move away or separate from one another. Rotation ceases when each foot element 4*a*, 4*b* is parallel to the respective leg 3*a*, 3*b* as illustrated in FIG. 9*b*. Next, the leg 3*a*, 3*b* are rotated in opposite directions about the minor axis 42 and toward one another as illustrated in FIG. 9*b*. Rotation ceases when each leg 3*a*, 3*b* is parallel or nearly parallel to the desktop 2 as illustrated in FIG. 9*a*.

Figure 10:
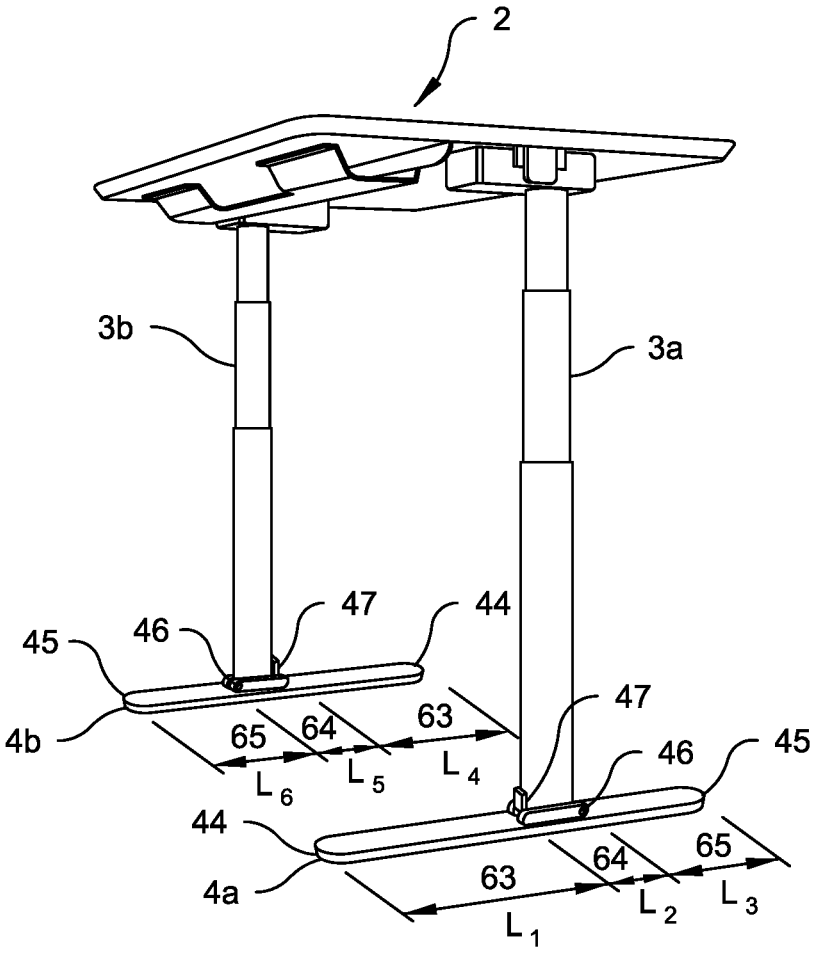
FIG. 10 is a perspective view illustrating arrangement of first portion, second portion, and third portion of each foot element in accordance with an embodiment of the invention.

Referring now to FIG. 10, one foot element 4*a* is generally defined by a first portion 63 with a length $L_1$, a second portion 64 with a length $L_2$, and a third portion 65 with a length $L_3$; whereas, another foot element 4*b* is generally defined by a first portion 63 with a length $L_4$, a second portion 64 with a length $L_5$, and a third portion 65 with a length $L_6$. The first portion 63 is disposed between a first end 44 of the foot element 4*a* or 4*b* and a latch point 47. The second portion 64 is disposed between the latch point 47 and a hinge point 46. The third portion 65 is disposed between the hinge point 46 and a second end 45 of the foot element 4*a* or 4*b*. The latch point 47 corresponds to the location at which the leg 3*a*, 3*b* is releasably secured to the foot element 4*a*, 4*b*. The hinge point 46 corresponds to the location at which the foot element 4*a*, 4*b* rotates with respect to the leg 3*a*, 3*b*. In most embodiments, the lengths $L_2$ and $L_5$ are equal to or greater than the width of the legs 3*a*, 3*b*. The lengths $L_1$ and $L_4$ and the lengths $L_3$ and $L_6$ generally correspond to the overhang by the foot elements 4*a*, 4*b* with respect to the legs 3*a*, 3*b*. In preferred embodiments, the total length ($L_1+L_2+L_3$; $L_4+L_5+L_6$) of the respective legs 3*a*, 3*b* are equal, length $L_1$ is equal to or greater than the sum of length $L_2$ and length $L_3$, length $L_4$ is equal to or greater than the sum of length $L_5$ and length $L_6$, and length $L_1$ is equal to length $L_4$ so that the first end 44 and the second end 45 at the same side of the legs 3*a*, 3*b* are equidistant from the respective distal edge 10 and proximal edge 32. The preferred arrangement symmetrically aligns the foot elements 4*a*, 4*b* below the desktop 2 even though the legs 3*a*, 3*b* are non-symmetrically situated.

Figure 11:
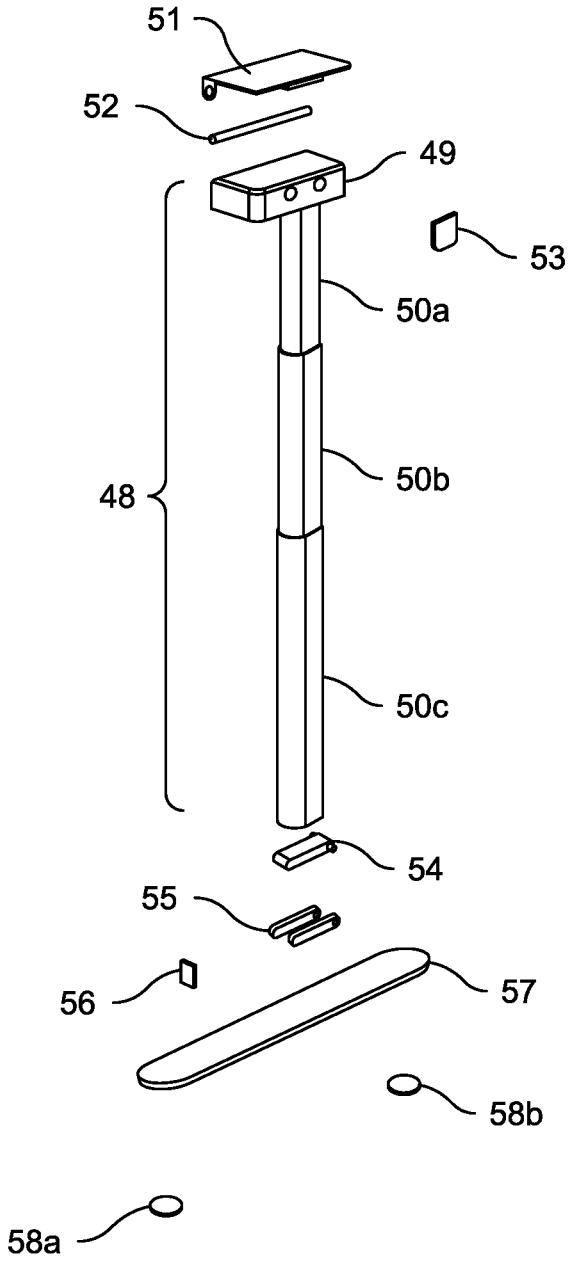
FIG. 11 is an exploded view illustrating components of leg hinge, leg, foot hinge, and foot element in accordance with an embodiment of the invention.

In some embodiments, the legs 3*a*, 3*b* may be lengthwise adjustable rather than of fixed length. Referring now to FIG. 11, an adjustable-length leg 48 may be composed of two or more leg segments 50*a*, 50*b*, 50*c*, three illustrated by way of example in FIG. 11, arranged end-to-end and telescopically so as to permit extension and retraction thereof by a motor 49. In preferred embodiments, the motor 49 is attached at one end of one leg segment 50*a* and mechanically coupled either directly or indirectly to the leg segments 50*a*, 50*b*, 50*c*. The leg segments 50*a*, 50*b*, 50*c* move apart and therefore extend when the motor 49 operates in a first mode and move toward one another and therefore retract when the motor 49 operates in a second mode.

Figure 12:
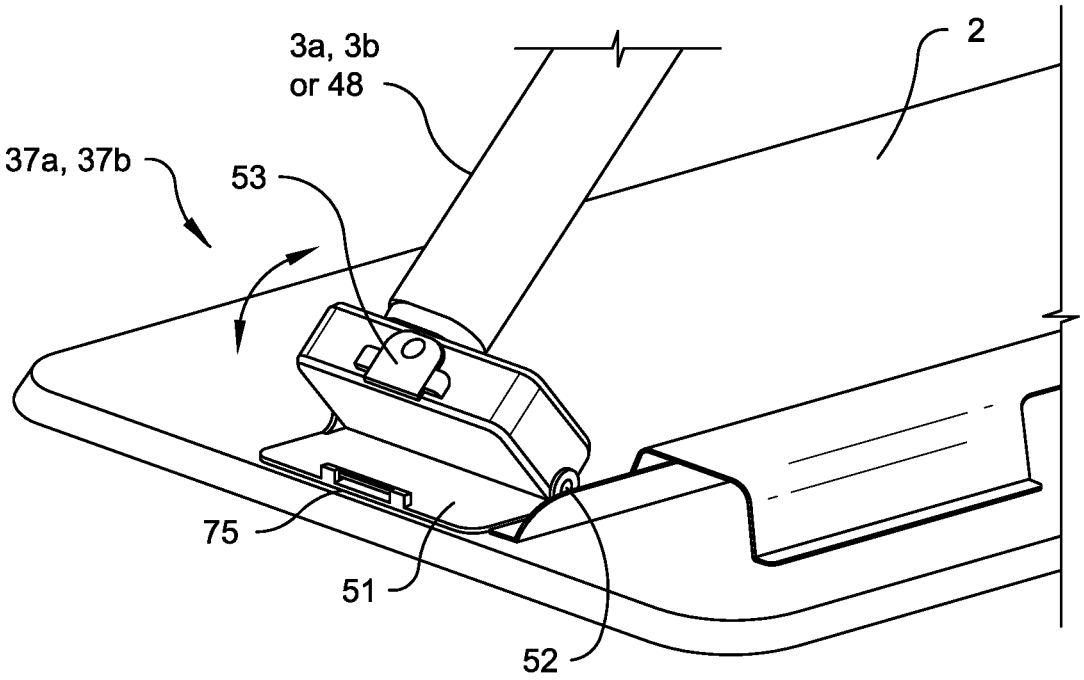
FIG. 12 is a perspective view illustrating a leg hinge with locking and unlocking feature facilitating rotatable attachment of a leg to a desktop in accordance with an embodiment of the invention.

Referring again to FIGS. 9*a*, 11, and 12, each leg 3*a*, 3*b* or 48 is rotatably secured to a hinge plate 51 via a pin 52. The pin 52 engages both structures comprising the leg 3*a*, 3*b* or 48 and the hinge plate 51 so as to allow rotation by the leg 3*a*, 3*b* or 48 about the hinge plate 51. The hinge plate 51 is fixed to the lower surface 8 of the desktop 2 via mechanical, adhesive or other means understood in the art. In preferred embodiments, the resultant leg hinge 37*a*, 37*b* should permit at least ninety degrees of rotation. A latch 53 is provided adjacent to and opposite of the pin 52 so as to engage and disengage a hook 75, preferably along the hinge plate 51, to enable the leg 3*a*, 3*b* or 48 to be releasably secured with respect to the desktop 2 when placed in the upright configuration 72. The latch 53 may include a biasing means, such as a spring or the like, which causes the latch 53 to grasp the hook 75 when positioned into contact with the hook 75 and which also requires the user to depress or pull the latch 53 and thereby negate the biasing feature so as to release the latch 53 from the hook 75 when a leg 3*a*, 3*b* is configured from upright position to stowed position.

Figure 13:
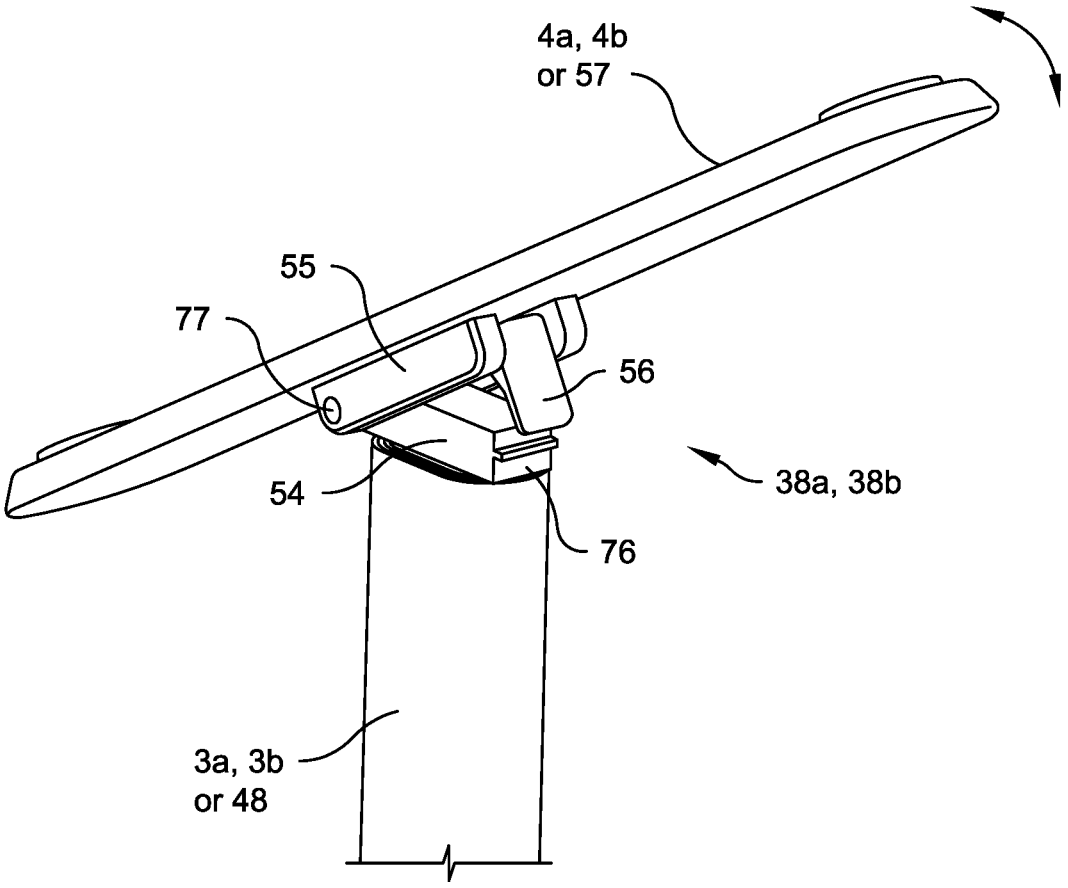
FIG. 13 is a perspective view illustrating a foot hinge with locking and unlocking feature facilitating rotatable attachment of a foot element to a leg in accordance with an embodiment of the invention.

Referring again to FIGS. 9*b*, 11, and 13, the foot element 4*a*, 4*b* is rotatably secured to an end of the leg 3*a*, 3*b* or 48 via an ankle plate 54 and a hinge plate 55. The ankle plate 54 is mechanically fastened to the end of the leg 3*a*, 3*b* or 48. The hinge plate 55 is rotatably attached to the ankle plate 54 via a pin 77. The pin 77 engages both ankle plate 54 and hinge plate 55. The hinge plate 55 is fixed to a foot element 4*a*, 4*b* or 57 via mechanical, adhesive or other means understood in the art so as to allow rotation of the foot element 4*a*, 4*b* or 57 with respect to the leg 3*a*, 3*b* or 48. In preferred embodiments, the resultant foot hinge 38*a*, 38*b* should permit at least ninety degrees of rotation. A latch 56 is provided along the hinge plate 55 adjacent to and opposite of the pin 77 so as to engage and disengage a tab 76, preferably along and extending from the ankle plate 54, to enable the foot element 4*a*, 4*b* to be releasably secured with respect to the leg 3*a*, 3*b* or 48 when placed in the upright configuration 72. The latch 56 may include a biasing means, such as a spring, which causes the latch 56 to grasp the tab 76 when placed into contact with the tab 76 and which also requires the user to depress or pull the latch 56 and thereby negate the biasing feature so as to release the latch 56 from the tab 76 when a foot element 4*a*, 4*b* is configured from upright position to stowed position. Each latch 53, 56 facilitates tool-free reconfiguration of the desk system 1 to form either a stowed configuration 71 or an upright configuration 72. One or more pads 58*a*, 58*b* may be attached along the bottom end of each foot element 4*a*, 4*b* to prevent damage to the supporting surface 73 and/or for leveling purposes.

Figure 14:
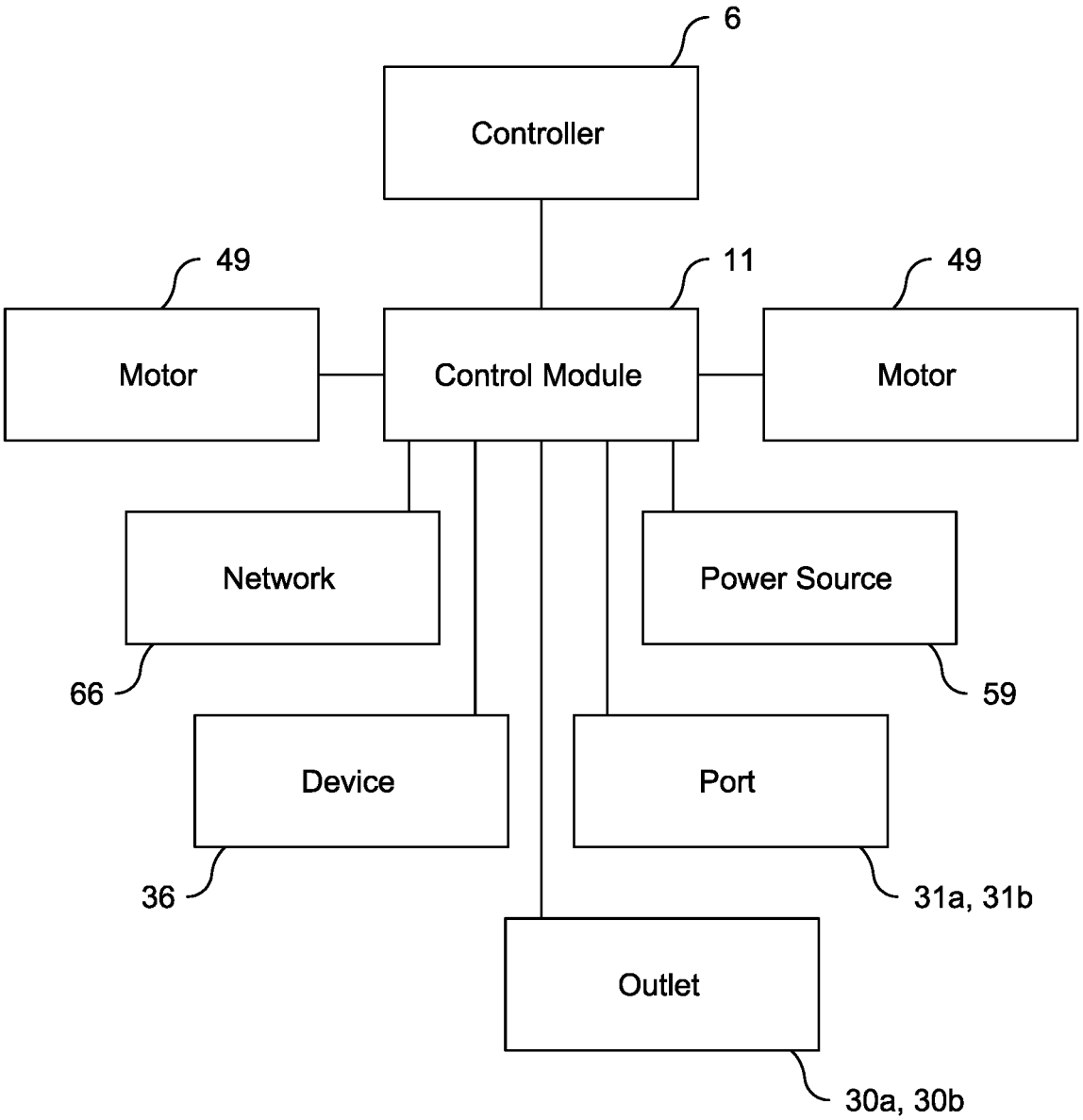
FIG. 14 is a block diagram illustrating exemplary connectivity between control module and optional components such as a controller, motor(s), power supply, port, outlet, device, and communications networks in accordance with an embodiment of the invention.

Referring now to FIG. 14, the control module 11 may enable communication between and functionality of various components of the desk system 1. In one example, the motors 49 and the controller 6 could communicate with the control module 11 to enable functionality of the adjustable-length legs 48 via the controller 6. In another example, the control module 11 could electrically communicate with a power supply 59 external to the desk system 1 so as to supply power to components directly wired to the control module 11. In yet another example, the outlets 30*a*, 30*b* and the ports 31*a*, 31*b* may communicate directly with the control module 11. The ports 31*a*, 31*b* may facilitate access to a network 66 communicable with the control module 11. In still other embodiments, additional device(s) 36, such as computer, printer or router, could electrically communicate with the control module 11 and other components attached thereto.

The description above indicates that a great degree of flexibility is offered in terms of the invention. Although various embodiments have been described in considerable detail with reference to certain preferred versions thereof, other versions are possible. Therefore, the spirit and scope of the appended claims should not be limited to the description of the preferred versions contained herein.

What is claimed is:

1. A desk system comprising:

(a) a desktop with an upper surface and a lower surface bounded by a proximal edge, a distal edge and a pair of side edges, said desktop including a major axis perpendicular to a minor axis;

(b) a pair of legs, each said leg having a proximal face and a distal face; and (c) a pair of foot elements, each said leg rotatably attached at one end to said desktop and attached at another end to one said foot element, said foot element rotatable with respect to said leg;

wherein a first of said legs disposed between said proximal edge and said proximal face along a second of said legs, said second of said legs disposed between said distal edge and said distal face along said first of said legs, said proximal face and said distal face with an offset therebetween along said minor axis, said desk system disposed in a stowed configuration when said legs and said foot elements are substantially parallel to said lower surface and said legs disposed between and substantially parallel to said foot elements, said desk system disposed in an upright configuration when said legs are substantially perpendicular to said lower surface and each said leg substantially perpendicular to one said foot element, said desk system is capable of being configured from said stowed configuration to said upright configuration by separately rotating said legs about said minor axis in opposite directions away from one another and by separately rotating said foot elements about said major axis in opposite directions toward one another, said desk system is capable of being configured from said upright configuration to said stowed configuration by separately rotating said foot elements about said major axis in opposite directions away from one another and by separately rotating said legs about said minor axis in opposite directions toward one another.

2. The desk system of claim 1, wherein one said leg hingedly attached and releasably securable along said lower surface adjacent to one said side edge, and another said leg hingedly attached and releasably securable along said lower surface adjacent to another said side edge.

3. The desk system of claim 1, wherein one said foot element hingedly attached and releasably securable to one said leg, and another said foot element hingedly attached and releasably securable to another said leg.

4. The desk system of claim 1, wherein each said foot element includes a first portion bounded by a first end and a latch point, a second portion bounded by said latch point and a hinge point, and a third portion bounded by said hinge point and a second end.

5. The desk system of claim 4, wherein said first portion is at least as long as said second portion and said third portion combined.

6. The desk system of claim 1, wherein said desktop includes an upper layer, an intermediate layer, and a lower layer cooperating to form a pocket with a porous layer therein.

7. The desk system of claim 6, wherein said porous layer is in the form of a honeycomb.

8. The desk system of claim 1, further comprising:

(d) a bezel disposed within an opening along said desktop adjacent to said distal edge, said bezel includes a slot, at least one outlet, or at least one port.

9. The desk system of claim 8, wherein a handle formed by said upper layer, said intermediate layer, and said lower layer disposed between said slot and said distal edge.

10. The desk system of claim 1, further comprising:

(d) a controller disposed within an opening along said desktop biased toward said proximal edge and one said side edge.

11. The desk system of claim 1, further comprising:

(d) a tray attached to said desktop along said lower surface to form a cavity therebetween, said cavity capable of accepting a cable for support and concealment by said tray.

12. The desk system of claim 1, wherein said legs are of fixed length.

13. The desk system of claim 1, wherein said legs are extendable and retractable to adjust the height of said desktop.

14. The desk system of claim 13, wherein each said leg includes a motor for extending and retracting said leg.

15. The desk system of claim 14, further comprising:

(d) a control module communicable with said motor in each said leg and a controller.

16. The desk system of claim 15, wherein said control module facilitates access to a network.

17. The desk system of claim 15, wherein cables between said controller and each of said motors and said control module are at least partially concealed within said desktop between an upper layer and an intermediate layer, said upper layer and a porous layer, a lower layer and said porous layer, or said lower layer and said intermediate layer.

18. The desk system of claim 1, wherein a cross member is attached to said desktop along said lower surface.

19. The desk system of claim 1, wherein a latch releasably secures said leg to said desktop when disposed in said upright configuration enabling tool-free reconfiguration of said desk system.

20. The desk system of claim 1, wherein a latch releasably secures said foot element to said leg when disposed in said upright configuration enabling tool-free reconfiguration of said desk system.

* * * * *